US005107608A

United States Patent [19]

Kreitenberg

[11] Patent Number: 5,107,608

[45] Date of Patent: Apr. 28, 1992

[54] SAFETY RELEASING SKI BOOT

[76] Inventor: Arthur Kreitenberg, 12216 Shetland La., Los Angeles, Calif. 90049-4030

[21] Appl. No.: 591,989

[22] Filed: Oct. 2, 1990

[51] Int. Cl.[5] ..... A43B 5/04

[52] U.S. Cl. ..... 36/117; 36/50; 36/1; 24/69 SK; 24/68 SK

[58] Field of Search ..... 36/1, 117, 50, 121, 36/131, 118-120, 45, 83

[56] References Cited

U.S. PATENT DOCUMENTS

| | | | |
|---|---|---|---|
| 1,927,420 | 9/1933 | Sapluk | 36/45 |
| 2,755,566 | 7/1956 | Harrison | 36/1 X |
| 4,060,256 | 11/1977 | Collombin et al. | 36/121 X |
| 4,499,676 | 2/1985 | Chalmers, II | 36/120 |
| 4,596,080 | 6/1986 | Benoit et al. | 36/120 |
| 4,633,599 | 1/1987 | Morell et al. | 36/50 |
| 4,669,201 | 6/1987 | Pozzobon | 36/117 |
| 4,677,770 | 7/1987 | De Marchi et al. | 36/120 |
| 4,677,771 | 7/1987 | Arieh | 36/120 |
| 4,680,878 | 7/1987 | Pozzobon et al. | 36/117 |
| 4,689,902 | 9/1987 | Lewis, Jr. | 36/50 X |
| 4,694,592 | 9/1987 | Baggio et al. | 36/117 |
| 4,697,360 | 10/1987 | Sartor | 36/2.6 |
| 4,739,563 | 4/1988 | Guggenberger et al. | 36/117 |
| 4,765,069 | 8/1988 | Baggio | 36/50 |
| 4,839,973 | 6/1989 | Dodge | 36/121 |
| 4,887,370 | 12/1989 | Okada | 36/120 |
| 4,910,888 | 3/1990 | Perrissoud | 36/50 |

FOREIGN PATENT DOCUMENTS

| | | | |
|---|---|---|---|
| 0020315 | 12/1980 | European Pat. Off. | 36/117 |
| 2922497 | 6/1976 | France | 36/117 |

OTHER PUBLICATIONS

McConkey, J. P., *The American Journal of Sports Medicine* 14:No. 2: pp. 160-164 (1986), "Anterior Cruciate Ligament Rupture in Skiing".

Johnson, C., and Hull, M. L., *J. Biomechanics* 21: No. 5: pp. 401-415 (1988), "Parameter Identification of the Human Lower Limb Under Dynamic, Transient Torsional Loading".

Dorius, L. K. and Hull, M. L., *J. Biomechanics* 17: No. 1: 1-9 (1984), "Dynamic Simulation of the Leg in Torsion".

Pope, M. H. and Johnson, R. J., *Biomaterials, Medical Devices and Artificial Organs* 9: No. 1: 1-13 (1981), "Skiing Injuries".

Abdalla, F. H. et al., *The American Journal of Sports Medicine* 10: No. 6: 368-370 (1982), "Avulsion of Lateral Tibial Condyle in Skiing".

MacGregor, D. et al., *J. Biomechanics* 18: No. 4: 255-265 (1985), "A Microcomputer Controlled Snow Ski Binding System—I. Instrumentation and Field Evaluation".

Howe J. and Johnson, R. J., *Orthopedic Clinics of North America* 16: No. 2: 303-314 (1985), "Knee Injuries in Skiing".

Freeman, J. R. et al., *Clinical Orthopaedics and Related Research* No. 216: 19-23 (1987), "Changing Patterns in Tibial Fractures Resulting from Skiing".

Higgins, R. W. and Steadman, J. R., *The American Journal of Sports Medicine* 15: No. 5: 439-447 (1987), "Anterior Cruciate Ligament Repairs in World Class Skiers".

Bouter, L. M. et al., *The American Journal of Sports Medicine* 17: No. 2: 226-233 (1989), "Binding Function in Relation to Injury Risk in Downhill Skiing".

(List continued on next page.)

*Primary Examiner*—Paul T. Sewell
*Assistant Examiner*—Beth Anne C. Cicconi
*Attorney, Agent, or Firm*—Charles Berman

[57] ABSTRACT

A ski boot for lessening the incidence of knee injuries when the boot exerts a forward directional force on the skier's leg and includes a foot portion and a leg element. The foot portion and the leg element are in a first essentially rigid support position for the foot and lower leg for normal operative skiing position. Releasing means changes the rigid support position for the foot and the lower leg on application of a predetermined level of force by the boot on the wearer. Movement of one element of the leg portion permits the lower leg and foot of the wearer to adopt a second position different to the relative fixed location for normal skiing.

22 Claims, 4 Drawing Sheets

OTHER PUBLICATIONS

McConkey, J. P. et al., *The American Journal of Sports Medicine* 16: No. 2: 159-164 (1988), "Tibial Plateau Fractures in Alpine Skiing".

Peter, R. E. et al., *The American Journal of Sports Medicine* 16: No. 5: 486-491 (1988), "Skier's Lower Leg Shaft Fracture".

Schaffer, D. J., *Annals of Emergency Medicine* 10: No. 9: 472-475 (1981), "Knee Ligament Injuries Induced by Skiing".

Feagin, Jr., J. A. et al., *Clinical Orthopaedics and Related Research:* No. 216: 13-18 (1987), "Consideration of the Anterior Cruciate Ligament Injury in Skiing".

France, E. P. et al., *J. Biomechanics* 16: No. 8: 553-564 (1983), "Simultaneous Quantitation of Knee Ligament Forces".

Kuo, C. Y. et al., *J. Biomechanics* 16: No. 8: 609-624 (1983), "Field Measurements in Snow Skiing Injury Research".

SAFETY RELEASING SKI BOOT

BACKGROUND

This invention relates to ski boots. In particular, it relates to a boot for enhancing the safety of skiing.

The leg of a skier may be seriously injured due to unexpected forces and pressures applied to the leg, which can include the thigh, knee, calf, lower leg, ankle or foot. In particular, a skier's knee may be seriously injured by a forward directed force on the back of the lower leg when the thigh and foot are in a fixed relationship. In some skiing conditions, knee injury arises from forces which occur at the leg-boot interface while no significant distractional or rotational forces occur at the boot-ski interface.

Alpine, or downhill snow skiing currently has an injury rate of 2 to 3 per 1,000 skier-days. This translates to approximately 500,000 injuries requiring the services of "Ski Patrol" per year in the United States.

The bone of the thigh, namely, the femur, is joined to the major bone of the lower leg, namely, the tibia, by several ligaments and muscles spanning the knee joint. One of these ligaments, the Anterior Cruciate Ligament (ACL), prevents excessive forward translation of the tibia relative to the femur. Forces greater than the ultimate strength of the ACL result in rupture of this ligament. ACL injury incidence has increased about 500% while other ski injuries have decreased to less than about 50% of 1970 levels due to improvements in safety equipment. Higher, stiffer and forward leaned boots are believed to have shifted the site of injury to the knee.

Previously, ski safety devices were located at the bindings affixing the boot to the ski. The boot was released from the ski when excessive upward forces were present at the boot heel or when torquing forces were present at the boot toe. These devices have successfully lessened ankle and tibia injury incidence.

A few toe piece bindings also release in response to an upward force in an effort to protect the knee. However, these upward forces may be negated by the weight of the skier transmitted through the boot to the ski. This renders the release mechanism ineffective despite injurious forces acting at the knee. Thus, because of their design and location, ski bindings may not be able to release in response to injurious forces directed at the skier's leg that are not detected at the ski binding. For example, as depicted in FIG. 2, in a situation when a skier is landing from a jump or descending from a bump, the rear portion of the ski first contacts the snow covered ground. The weight of the skier acting on the ski causes a clockwise rotation of the ski and the boot attached to the ski also rotates forward. This causes pressure applied to the calf by the rear of the leg element of the boot. The thigh and the remainder of the skier's body are relatively fixed by inertia. The resulting force directed against the skier's calf may be great enough to exceed the strength of the ACL and cause its rupture.

The ski bindings do not release in this situation because (1) the downward force of the skier's weight negates any upward forces which otherwise might cause release; and (2) the injurious forces directed against the skier's calf are oriented in a direction parallel to the long axis of the ski. Known ski bindings respond only to forces on the ski in a direction perpendicular to the long axis of the ski.

A system for protecting skiers against the rising incidence of ACL knee and leg injuries would be of considerable value.

SUMMARY

A safety ski boot is provided which lessens the incidence of ACL injury of the wearer's legs. Sensing of the injurious force on the leg by the boot is preferably affected before a boot release is operative.

The ski boot contains a foot portion which has a base and an upper for surrounding essentially the foot of the wearer. A leg element surrounds essentially the lower portion of the leg of the wearer. The foot portion and the leg element are interconnected to constitute an essentially rigid support position for the foot and the lower leg in a normal operative skiing position. This locates the foot and the lower leg in a relatively fixed relationship. Releasing means is provided for changing the rigid support position for the foot and lower leg on application of a predetermined variable level of force by the boot on the wearer.

In one embodiment, the boot is rear opening, wherein the leg element includes a rear leg component affixed to a front leg component. The rear component is pivotally connected to the base.

The releasing means includes closing apparatus which couples locations on the front leg element and rear leg element in its forward, or closed position when the boot has been closed and is in normal operative position. The closing apparatus senses compressive force between the rear leg element and the skier's lower leg to release, or uncouple, the locations on the rear leg element and the front leg element when the compressive force exceeds a predetermined and variable level. As a result, the rear leg element can responsively open to release the leg from the boot, or at least prevent the imposition of a large forward directed force on the skier's lower leg.

The force can be sensed by a sensing means. Forces can be sensed and released at different locations in the direction of the occurrence.

The releasing means may then be reset to close the boot and render it operative again in the normal position. The releasing means can be of mechanical, hydraulic, pneumatic, electrical or magnetic construction.

In a mechanical construction embodiment, there are first and second members coupled to locations on the rear leg component and front leg component. A mechanical latch with first and second parts is connected respectively to the first and second members. When the compressive force between the rear leg element and the skier's lower leg exceeds a predetermined level, the second part of the latch pulls away from the first part and tends to move the first part to a release position. A biasing member resists such movement of the first part but allows such movement when the force on the first part exceeds a predetermined level. The level can be a function of the weight and ability of a skier or predetermined stress levels.

In a hydraulic or pneumatic configuration, there is a bladder filled with liquid or gas interposed, for example, between the rear leg element and the skier's calf or lower leg. The interior of the bladder is connected to a latch or pin securing the closure mechanism between the front and rear leg elements. When the pressure within the bladder exceeds a predetermined level, the said latch or pin actuates the release mechanism at said closure, opening the boot. The releasing pressure may be varied by changing the quantity of content or volume of the bladder.

In an electrical construction, at least one electrical force sensor coupled to the rear leg element generates an electrical signal of a level dependent on the magnitude of the compressive force between the rear leg element and the skier's calf or lower leg. The electrical signal is amplified and energizes an electrically operated latch which uncouples the locations on the rear leg element and front leg element when the sensor senses a force above the given level.

The invention will be further illustrated from the following description and the accompanying drawings.

DRAWINGS

DESCRIPTION

Figure 1:
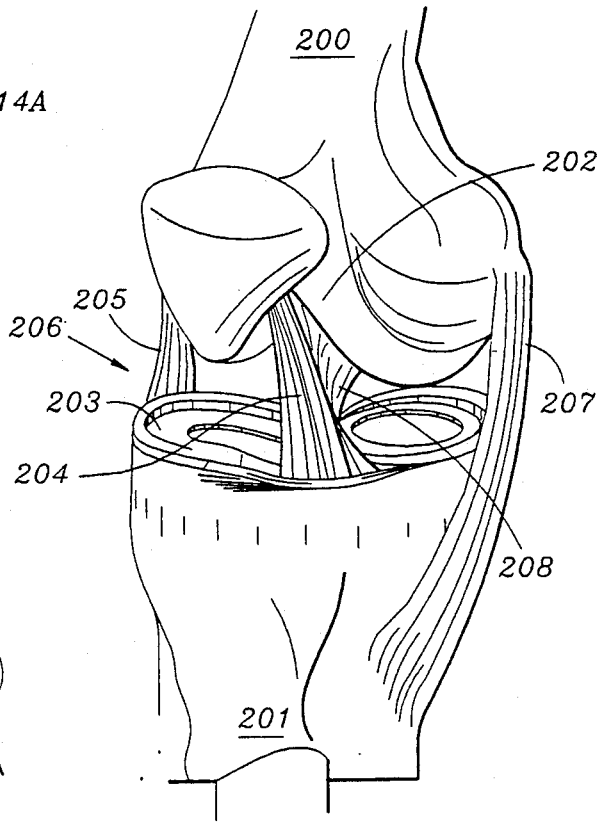
FIG. 1 is a diagrammatic view of the various ligaments and components about a right knee.

In FIG. 1, there is illustrated diagrammatically a portion of the leg, namely, the anatomical characteristics about the right knee. A thigh bone or femur 200 is connected through a knee joint with a shin bone or tibia 201. Below the femur 200 is an articular cartilage 202 and above the tibia 201 is a meniscus cartilage 203. Four ligaments join the femur 200 with the tibia 201. There is the Anterior Cruciate Ligament (ACL) 204 which connects the femur 200 to the tibia 201 in the center of the knee. This ligament limits rotation and forward motion of the tibia 201. There is a Lateral Collateral Ligament (LCL) 205 which runs on the outside of the knee 206 and limits sideways motion. There is a Medial Collateral Ligament (MCL) 207 which runs down the inside of the knee 206. This connects the femur 200 to the tibia 201 and also limits sideways motion of the knee 206. The Posterior Cruciate Ligament (PCL) 208 connects the femur 200 and the tibia 201. This limits backwards motion of the tibia 201.

The tibia 201 forms part of the lower leg and calf region. The lower leg detail is further illustrated in FIG. 2. The lower portion of the tibia 201 is illustrated as 209 which is connected through the ankle 210 with a foot 211.

Figure 2:
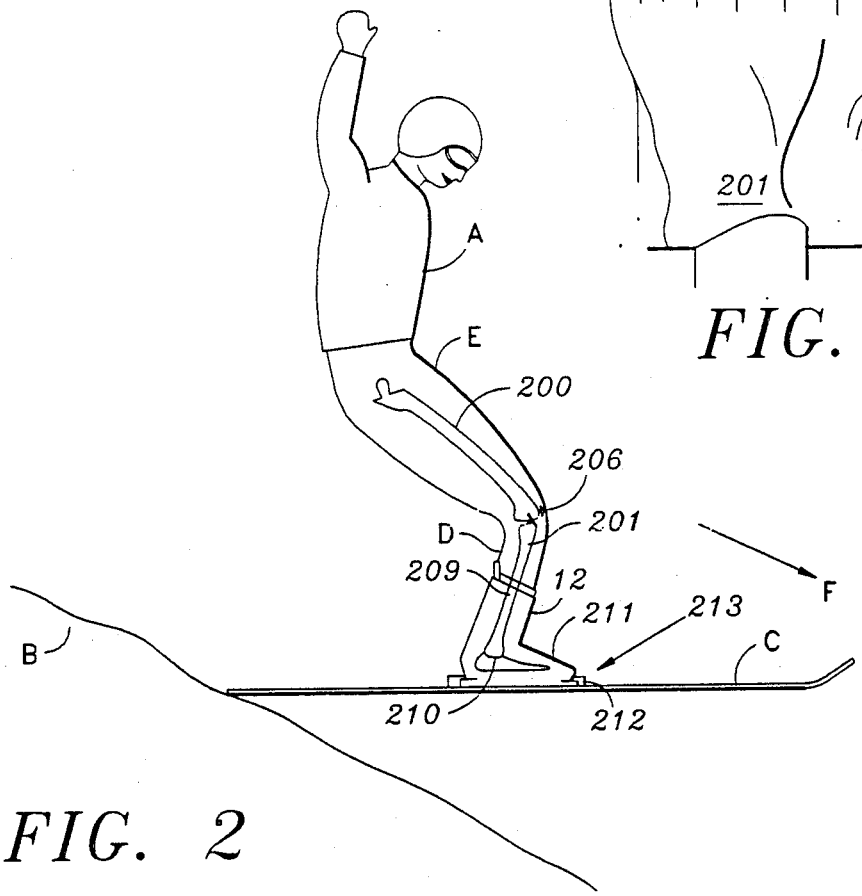
FIG. 2 is a side elevation view of a skier experiencing a large boot induced force on his ACL which could cause injury, and of a boot constructed in accordance with the present invention.

FIG. 2 illustrates a skier A who has jumped and landed on sloping ground B which suddenly rotates the ski C in a clockwise direction, pivoting about the rear of the ski. The boots 12 are mounted on the ski C and exert a forward directed pressure on the calf D. However, the rest of the skier's body, including the thigh E, is relatively fixed by inertia. This results in the skier's calf and lower leg 209 thrusting in a forward direction F relative to the thigh D. The forward thrust on the calf D or lower leg 209 can result in ACL (Anterior Cruciate Ligament) injury at the knee 206 which connects the tibia 201 of the leg to the femur 200 in the thigh.

If a binding 212 which connects the toe 213 of the boot 12 to the ski could responsively release, this would prevent injury to the ACL. However, the large downward force of the skier's foot 211 through the boot 12 onto the ski C negates the upward force of the toe 213 of the boot 12 relative to the ski C.

Injury to the ACL ligament 204 should be avoided by the invented boot.

Figure 3:
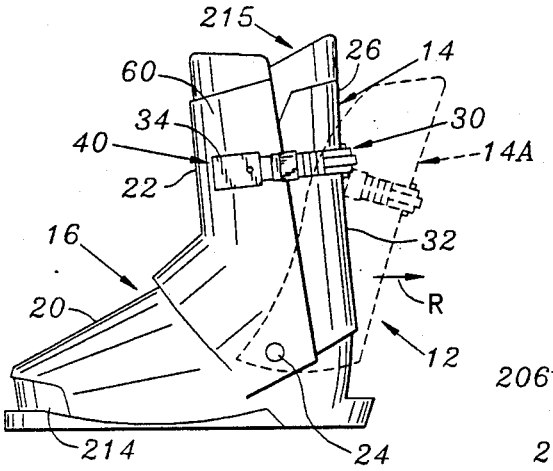
FIG. 3 is a side elevation view of the boot of FIG. 2.

As illustrated in FIG. 3, a boot 12 is constructed with a pivoting rear leg element 215 that responsively swings back to allow the lower leg 209 to move rearwardly when the lower leg 209 is thrust rearwardly with respect to a boot portion 16 essentially enclosing the foot 211.

As shown in FIG. 3, the ski boot 12 includes the boot portion 16 having an upper 20 that, together with a base 214, essentially surrounds most of the foot 211 of the wearer. A front leg element 22 supports the front of the wearer's lower leg 209. A rear leg element 215 is pivotally connected to the foot portion about a pivot location or axis 24. This allows the rear leg element 215 to move from a closed position 14 wherein the rear leg element 215 supports the wearer's calf and lower leg 209, to an open position 14A rearward of its closed position 14.

A tie 30 couples locations 32 on the rear leg element 215 and location 34 on the front leg element 22, to hold the rear leg element 215 in its closed position 14. The tie 30 can be released to allow the rear leg element 215 to pivot back so as to allow the skier to insert foot 211 and lower leg 209 into the boot 12 or withdraw the foot 211 and leg 209 therefrom. This boot 12 is a rear entry boot.

A releasing means includes closing apparatus 40 which couples the locations 32, 34 (through the tie 30 and other parts) on the rear leg element 215 and front leg element 22. The closing apparatus is constructed to sense the compressive force between the rear leg element and the skier's calf or lower leg 209. When the sensed compressive force exceeds a predetermined level, such as 175 pounds, the apparatus uncouples the locations 32 and 34 on the rear and front leg elements 215 and 22, respectively, to allow the rear leg element 215 to pivot to its open position 14A. This results in the wearer's lower leg 209 and the foot 211 moving back and out of the boot 12. This responsive opening of the rear leg element 215 limits the rearward force on the lower leg 209, relative to the upper femur 200 or thigh E of the wearer. This avoids injury, particularly to the ACL 204 to the knee 206. Other injury to the LCL 205 and MCL 207 should also be avoided.

Figure 13:
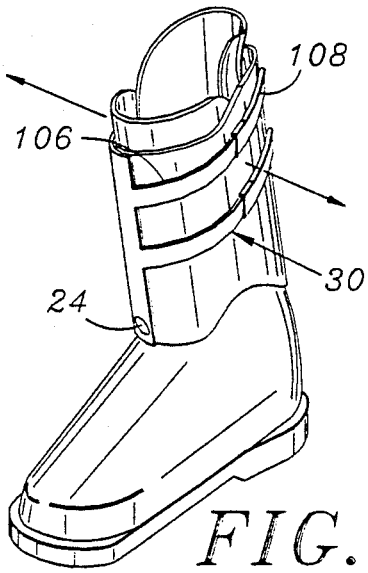
FIG. 13 is a diagrammatic view similar to FIG. 9 of the leg element of a boot for side opening.

As illustrated in FIG. 13, there is a side release boot which permits the movement of the lower leg 209 sideways relative to the leg element. This limits or minimizes injury to the LCL and MCL as described. The panels of the leg element are formed around both sides of the leg, and can open relatively in the front and the back. Sensors would be located in the side panels thereby to measure force on the sides of the leg.

Figure 4:
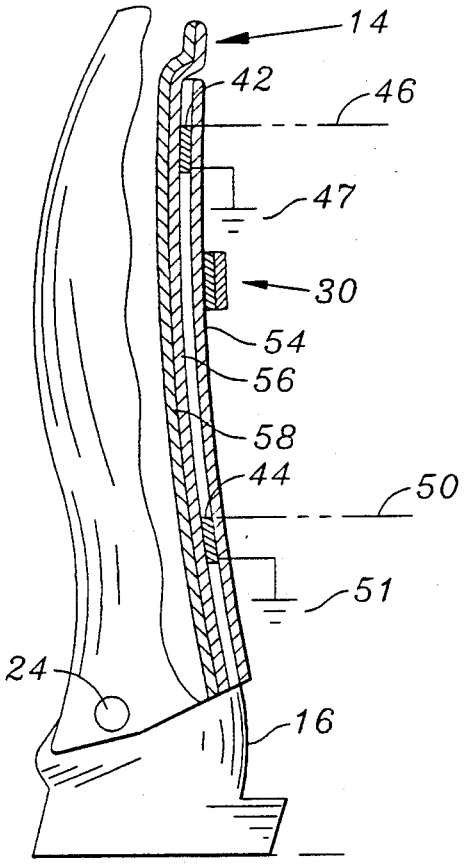
FIG. 4 is a sectional view of a portion of the boot of FIG. 3, showing a portion of a closing apparatus constructed in accordance with an electrical sensor embodiment of the present invention.

FIG. 4 illustrates a portion of the boot 12, namely, the rear leg element 215 of one embodiment of the invention. The rearward pressure of the person's lower leg 209 against the rear leg element 215, or torque about the rear leg element pivot axis, is sensed by force sensors 42, 44 which produce electrical outputs on lines 46, 47 and 50, 51. The particular rear leg element 215 includes an outer shell 54, an inner shell 56 spaced slightly from the outer shell, and a cushioning layer 58 lining the inner shell. The force sensors 42, 44 lie between the inner and outer shells and transmit forces between them. A variety of force sensors with electrical outputs are available. These are strips of piezoelectric material which produces an electrical current, and material whose resistance changes with the applied force.

Figure 5:
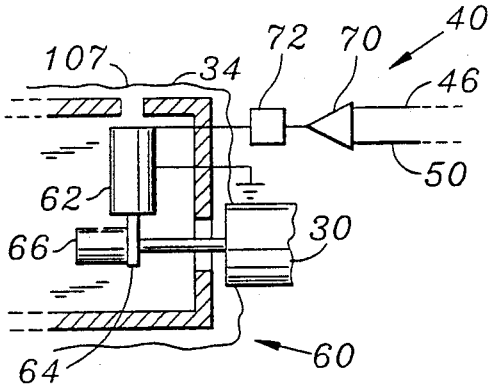
FIG. 5 is a partial sectional view of another portion of the closing apparatus partially shown in FIG. 4.

FIG. 5 shows another portion of the closing apparatus 40 which includes an electrically operated latch 60. A solenoid 62 moves a first part or plunger 64 connected to the main boot location 34, and a second part 66 connected to the tie member or tie 30 that is coupled to a location on the rear upper element 215. When the solenoid is energized, it lifts the plunger so as to release the second part 66 and allow the tie to become loose and the rear leg element 215 to pivot open.

The solenoid is energized through a sum amplifier 70 whose output equals the sum of the analog signals on the lines 46, 50 which are the outputs of the force sensors coupled to the rear leg element 215. When the outputs of the force sensors are sufficient to indicate that the force of the lower leg 209 against the rear leg element 215 exceeds a predetermined level, such as 175 pounds, the combined outputs are sufficient to drive the amplifier 70. When the output exceeds the threshold level of a threshold circuit part 72, it passes a current to the solenoid 62 that energizes it and moves the latch to a release position.

A mechanically depressible member indicated at 74 (FIG. 6) can be operated to manually operate the latch to allow the tie and therefore the rear leg element 215 to move to the open position. It is also possible to use a separate coupling between the second part 66 of the latch mechanism and a portion of the tie to allow the rear leg element 215 to be pivoted closed and locked in that position, or released, without operating the latching mechanism.

The releasing means locking the closing apparatus 40 is resettable. Thus, after a boot 12 has opened to adopt a position removed from the first fixed relationship, it is possible to reestablish the first fixed relationship.

In the first relationship, the foot 211 and lower leg 209 through the ankle 210 are held in the normal position for operative skiing. In the second position, changed from the first rigid support, the foot position and leg element are in a different location. This prevents injury to the knee 206 or other parts of the anatomy. The injury could be to any of the ligaments 204, 205, 207 or 208. In particular, the injury to the ACL, namely, 206 should be minimized and likely avoided.

Figure 7:
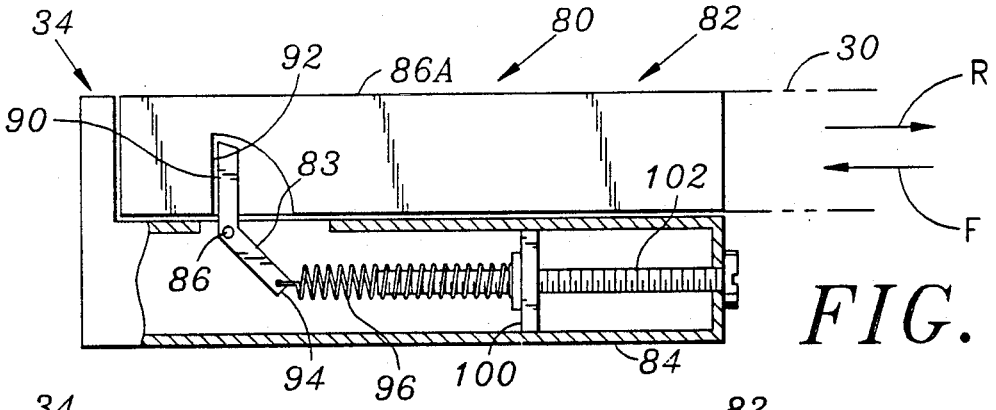
FIG. 7 is a partial sectional view of a closing apparatus constructed in accordance with a mechanical embodiment of the invention, shown in a closed or latched position.
Figure 8:
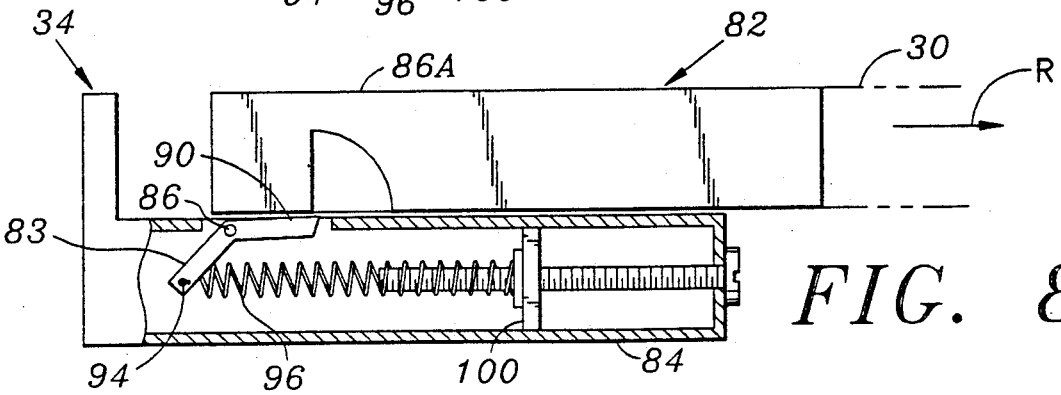
FIG. 8 is a view similar to that of FIG. 7, but with the mechanism in an opened or released position.
Figure 9:
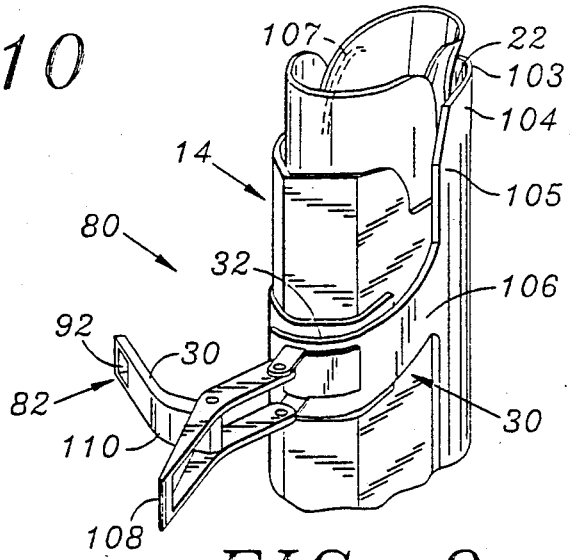
FIG. 9 is a partial perspective view of the embodiment of FIG. 7.

FIGS. 7-9 illustrate another embodiment of the closing apparatus 80 which is mechanical.

The apparatus includes a mechanical latch 82 (FIG. 7) comprising a first part 83 connected through a first member 84, at a pivot joint 86, to the location 34 on the main boot portion. The latch also includes a second part 86 a connected to the tie 30. The first part 83, which pivots about an axis at 86, has one end 90 engaged with a stop 92 formed on the first part, and has an opposite end 94 connected to a spring 96. The spring or biasing device 96 is coupled to a nut 100 that moves on a screw 102 to adjust the spring tension. The spring tension urges the first part 83 towards the position shown in FIG. 7 wherein it prevents the second part 86 from moving rearwardly in the direction R.

FIG. 8 shows the latch in a release; position wherein the tie 30 has applied sufficient rearward force in direction R for the second part 83. The part 86 to overcome the holding force of the second part 83. The first part 86 moves rearwardly to loosen the tie 30, and allow the rear upper element 215 to pivot open.

FIG. 9 illustrates some details of the tie or second member 30 which couples a location 32 on the rear cover 14 to a location on the main boot portion. The front leg part 22 of the main boot portion includes an outer shell 104 of a plastic material having a front 103 and opposite sides 105, 107. The shell has a rearward extension 106 extending from one side 105, that forms part of the tie 30. A latching device 108 is pivotally mounted on the rearward extension 106, and carries a rod 110 whose end portion forms the first part of the mechanical latch. The rearward extension 106 is flexible enough to easily bend out of the way when the cover 14 is pivoted rearwardly. However, the rearward extension 106 can withstand high tension forces; as a result, when the second part 86*a* fixed in the latch 92 and the latching device 108 is closed, the assembly forming the tie 30 prevents rearward pivoting of the rear leg element 215. It should be noted that most of the parts of the tie 30 are known in the prior art, but not the second part 86*a* which forms part of the mechanical latch that automatically opens when the force on the rear leg element 215 exceeds a predetermined and variable level.

The boot includes a closing apparatus which couples locations on the main boot portion and on the rear leg element 215, and uncouples and releases those locations to allow the rear leg element 215 to pivot open when the rearward force of the skier's calf on the rear cover exceeds a predetermined and variable level.

The closing apparatus can include one or more force sensors that generate electrical outputs which operate an electrically operated latch mechanism. The closing apparatus can include a solely mechanical latch mechanism which releases a pair of parts that allow the rear leg element 215 to open when the opening force on one of the parts exceeds a predetermined level.

While the latching mechanisms are preferably mounted on the leg element, and especially on the front leg part 212, it should be noted that the latch mechanisms could be mounted on the pivoting rear leg element 215.

Figure 6:
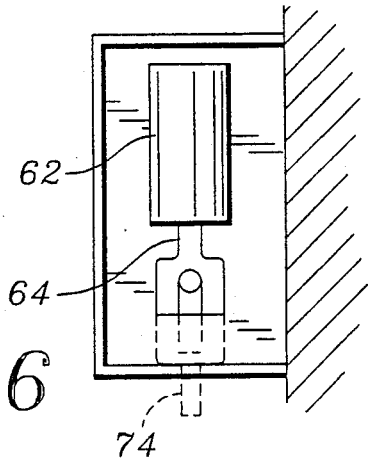
FIG. 6 is a sectional rear view of the apparatus of FIG. 5.
Figure 12:
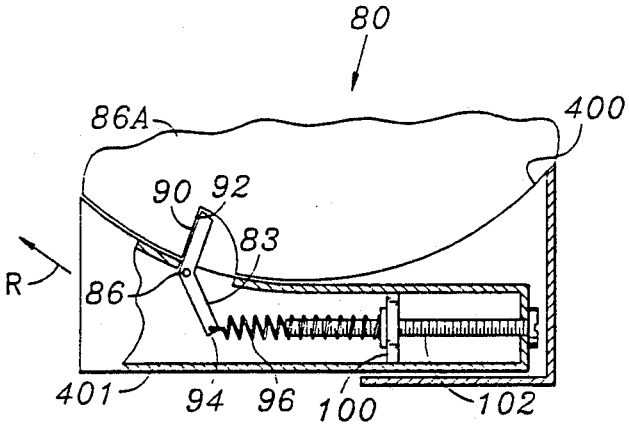
FIG. 12 is a partial sectional view of a closing apparatus constructed in accordance with a different mechanical embodiment.

In FIG. 12, similar characteristics to those illustrated in FIGS. 5 to 7 are illustrated. The upper element 400 has the stop 92 built into the wall of the leg element. The spring 96 with second part 83 is formed in the strap portion 401 as illustrated.

Figure 14:
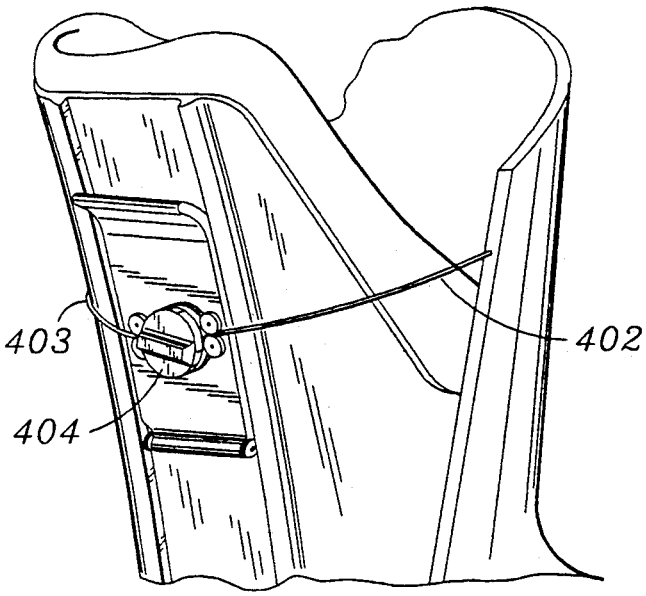
FIG. 14 is a diagrammatic perspective view of a rear entry boot having a mechanical cable system for securing the front leg element with the rear leg element.

In FIG. 14, cable pair 402 and 403 are affixed to the leg element such that the cables can be extended by turning the torque knob 404 which acts to wind the cables 402 and 403 around the knob 404. The releasing means and sensing means can operate with the cables 402 and 403.

Figure 15:
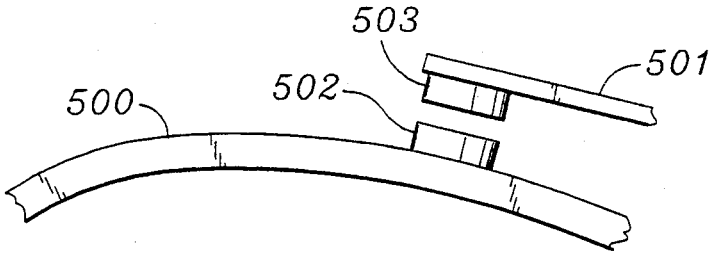
FIG. 15 is a diagrammatic partial view of the top of a leg element interacting with a strap operable with a magnetic release.

In FIG. 15, the leg element 500 interacts with the strap 501 so that a magnet 502 is interactive with magnet 503. Predetermined levels of magnet strength can secure the strap 501 with the leg element 500. When a pressure on the leg element exceeds a predetermined level, the magnets 502 and 503 can separate thereby permitting for a change of the rigid support position of the foot and lower leg in the boot.

Figure 16:
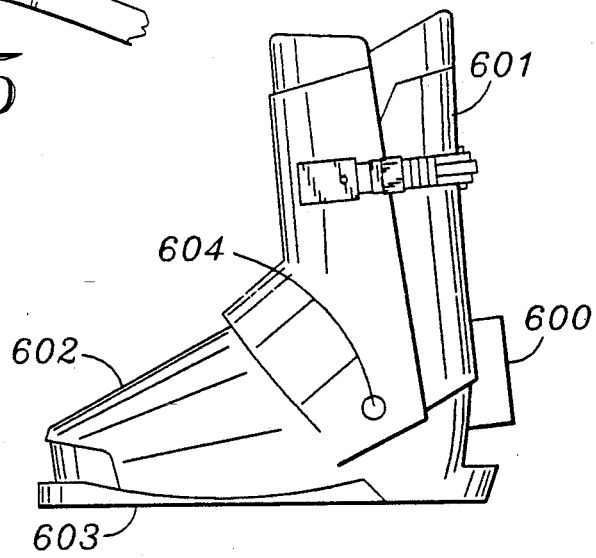
FIG. 16 is a side diagrammatic elevation of a boot with the release connected between the leg element and the upper or base.

In FIG. 16, the release 600 is shown between the leg elements 601 and the upper 602 and base 603 of the boot. Release of the upper element 601 is effected by permitting 600 to be released so that a portion of the leg element can move back or rock back about the pivot 604.

Figure 11:
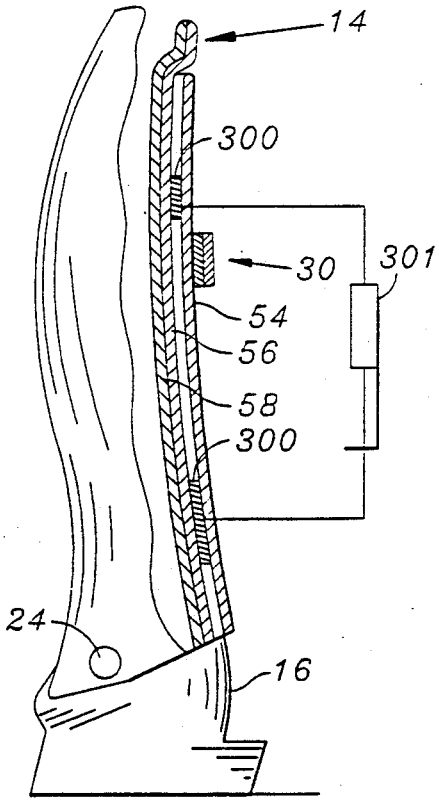
FIG. 11 is a sectional view of a portion of FIG. 3, showing a portion of a closing apparatus constructed in accordance with a pneumatic and hydraulic embodiment of the present invention.

In an alternative form illustrated in FIG. 11, a fluid being a gas or a liquid is contained in a bladder 300 which senses pressure between the rear leg element 209 and the skier's calf or lower leg 209 to actuate a pin or latch mechanism diagrammatically illustrated as 301 to activate a release 30 to allow the rear upper to pivot back. The closing apparatus can include one or more force sensors that generate electrical or mechanical outputs which operate an electrically or mechanically operated latch mechanism.

Although particular embodiments of the invention have been described and illustrated herein, it should be recognized that modifications and variations may readily occur to those skilled in the art.

Figure 10:
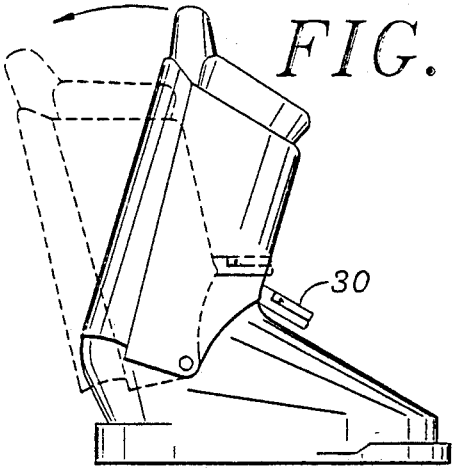
FIG. 10 is a side diagrammatic elevation of rock back ski boot.

For instance, in some cases, it may be possible to have the release mechanism internally configured within the leg element of the boot. In such a manner, the leg element can be made of a relatively rigid yet extendible material or a material which is folded in a first position and unfolded in a second extended position. Also, the boot can be of a kind for an overlaptype boot with closing mechanisms such as buckles extending from the upper at the ankle position towards the toe and along the leg element as appropriate. In some cases, forward release is possible in response to the force. In FIG. 10, a responsive rock back ski-boot is illustrated. The release means 30 is shown in the forward portion of the boot adjacent the upper and leg elements.

In this configuration, the leg 209 and foot 211 are not released. The leg element of the boot rocks back to prevent knee injury. The sensing and releasing means may be located anywhere on the boot.

The releasing means can be located in a particular circumferential position about the leg element. As such, it could be at the rear of the leg element, front of the leg element or on one or more sides of the element. There may be more than one releasing means for the boot. The releasing means can be located between the foot portion and the leg element so as to permit relative movement between the leg element and the foot portion. There may also be several sensing means located about the boot to detect force of the boot on the foot or lower leg at their respective interface. Such sensed force can be effectively transmitted to the releasing means. The scope of the invention is to be determined solely by the following claims. The claims should be interpreted to cover modifications and equivalents.

I claim:

1. A ski boot comprising a rigid foot portion having a rigid base and a rigid upper for surrounding essentially a foot of a wearer; a rigid leg element for surrounding essentially a lower portion of a leg of the wearer; pivot means; the foot portion and the leg element being connected through the pivot means to constitute an essentially rigid support position for the foot and the lower portion of the leg when the foot and the lower portion of the leg are in a normal operative skiing position thereby locating the foot and the lower portion of the leg in a relatively fixed relationship; and releasing means for changing the rigid support position for the foot and the lower portion of the leg on application of force exceeding a predetermined level by the wearer on the boot, thereby permitting a change in the location of the foot and the lower portion of the leg from a relatively fixed position, and including a resettable latch means for directly connecting the leg element to the rigid upper, the latch means having biasing means to resist movement from the rigid support position toward a release position while allowing movement when a release force exceeds a predetermined level, the biasing means being inherently resettable and being adjustable whereby the latch is activated at different predetermined levels of force application by the wearer on the boot.

2. A ski boot as claimed in claim 1 including means for sensing the force between the wearer and the boot at the location of the wearer's leg to which the force is directed, and means for relating the force level to the releasing means such that on sensing the level of force, the releasing means is rendered operative to permit change of the support position.

3. A ski boot as claimed in claim 1 including resettable means for restoring the releasing means to a position to constitute a rigid support position for the foot and the lower leg.

4. A ski boot as claimed in claim 1 wherein the leg element includes at least two separate elements, the elements being interengageable in a first position to rigidly support the position of the foot and the lower leg in a normal operative skiing position, and moveable to a second relative position wherein the foot and the lower leg relative relationship position is changed.

5. A ski boot as claimed in claim 4 wherein the releasing means interengages the two elements to constitute the first position and on releasing permits the change from the first position.

6. A ski boot as claimed in claim 4 wherein the two elements are manually movable thereby to permit insertion of the leg and foot into the boot and wherein manual action on releasing means permits locking of the elements.

7. A ski boot as claimed in claim 2 wherein the sensor means is located at the interface between the lower leg and the leg element, and wherein the force is measured selectively by electrical, mechanical, hydraulic, magnetic and pneumatic means.

8. A ski boot as claimed in claim 2 wherein the releasing means is located between the foot portion and the leg portion, the releasing means acting to permit a relative change between the foot portion and the leg element.

9. A ski boot for protecting the knee of a wearer, comprising:

a foot portion including a base and a rigid upper for surrounding most of the foot of the wearer;

a rigid front leg element for supporting the front of the wearer's lower leg;

pivot means;

a rigid rear leg element separate from the front leg element for pivotal connection at a pivot location of the pivot means to the foot portion for allowing the rear leg element to pivot between a closed position wherein the rear leg element supports the rear of the wearer's lower leg in a rigid support position, and an open position wherein the rear leg element is rearward of the closed position; and closing apparatus which couples locations on the foot portion and said rear leg element, the closing apparatus being constructed for sensing the rearward force of the wearer's lower leg on the rear leg element to uncouple the locations on the foot portion and the rear leg element when the rearward force exceeds a predetermined level and thereby to allow the rear leg element to pivot open, and including a resettable latch means for directly connecting the rear leg element to the rigid front leg element, the latch means having a biasing means to resist movement from a rigid support position toward a release position while allowing movement when a release force exceeds a predetermined level, the biasing means being inherently resettable and being adjustable whereby the latch is activated at different predetermined levels of force application by the wearer on the boot.

10. The ski boot as claimed in claim 9 wherein:

the closing apparatus includes first and second members coupled to the locations and a mechanical latch having first and second parts connected to the members, and wherein the second part pulls away from the first part by the force of the rear leg element tending to move to an open position, the first part being moveable between a latched position wherein holding the second part and a release position wherein releasing the second part for allowing the second member to release the rear leg element to pivot to the open position, and the second member applying a force tending to move the first member to the release position, the latch including a biasing member for resisting movement of the first part toward the release position while allowing movement of the second part to the release position when the force on the second part exceeds a predetermined level.

11. A ski boot for protecting the knee of the leg of a wearer, comprising:

a foot portion for surrounding most of the foot of the wearer;

a front leg element for supporting the front of the wearer's lower leg;

pivot means;

a separate rear leg element pivotally connected about a pivot axis of the pivot means to the foot portion for allowing the rear leg element to pivot between a closed position wherein the rear leg element supports the rear of the wearer's lower leg in a rigid support position, and an open position wherein the rear leg element is rearward of the closed position;

closing apparatus including a pair of members with one member coupled to the rear leg element for moving in a rearward direction when the leg element pivots toward the open position and an opposite forward direction when the leg element pivots toward the closed position, and with the other member coupled to the foot portion; and releasing means including a mechanical resettable latch having first and second parts connected to first and second of the members respectively, the first part being moveable between a latched position wherein the first part avoids release of the second part as the leg element cover tends to open, and a release position where the first part allows release movement of the second part for allowing the leg element cover for moving to the open position, the latch having a biasing device connected to the first part to resist movement of the first part from the latched position toward the release position while allowing movement when the release force on the second part exceeds a predetermined level the biasing device being inherently resettable and being adjustable whereby the latch is activated at different predetermined levels of force application by the wearer on the boot.

12. A ski boot as claimed in claim 1 wherein the predetermined level is variable.

13. A ski boot as claimed in claim 9 wherein the predetermined level is variable.

14. A ski boot comprising a rigid foot portion having a rigid base and a rigid upper for surrounding essentially a foot of a wearer; a rigid leg element for surrounding essentially a lower portion of a leg of the wearer, the leg element being constituted by at least two separable interdependent members; pivot means; the foot portion and the leg element being connected through the pivot means to constitute an essentially rigid support position for the foot and the lower leg when the foot and the lower leg are in a normal operative skiing position thereby locating the foot and the lower portion in a relatively fixed relationship; and releasing means for changing the rigid support position for the foot and the lower leg on application of force exceeding a predetermined level by the wearer on the boot, the releasing means being essentially transverse tie means for selectively securing the two separable independent members in a first support wherein there is the essentially rigid support position and a released position removed from the rigid support position, and including a resettable latch means for direct connection of the leg element to the rigid upper, the latch means having a biasing means to resist movement from a rigid support position toward a release position while allowing movement when a release force exceeds a predetermined level, the biasing means being inherently resettable and being adjustable whereby the latch is activated at different predetermined levels of force application by the wearer on the boot thereby permitting a change in the location of the foot and the lower leg from a relatively fixed position wherein the independent members are in a first position.

15. A ski boot as claimed in claim 1 wherein the force is exerted on the leg element in a direction substantially parallel to a ski in normal operative skiing position.

16. A ski boot as claimed in claim 9 wherein the force is exerted on the leg element in a direction substantially parallel to a ski in normal operative skiing position.

17. A ski boot as claimed in claim 11 wherein the force is exerted on the leg element in a direction substantially parallel to a ski in normal operative skiing position.

18. A ski boot as claimed in claim 14 wherein the force is exerted on the leg element in a direction substantially parallel to a ski in normal operative skiing position.

19. A ski boot as claimed in claim 1 wherein the releasing means changes from the rigid support position to a second position removed from the rigid position.

20. A ski boot as claimed in claim 9 wherein the releasing means changes from the rigid support position to a second position removed from the rigid position.

21. A ski boot as claimed in claim 11 wherein the releasing means changes from the rigid support position to a second position removed from the rigid position.

22. A ski boot as claimed in claim 14 wherein the releasing means changes from the rigid support position to a second position removed from the rigid position.

* * * * *